US008197224B2

(12) United States Patent
Kuttler et al.

(10) Patent No.: US 8,197,224 B2
(45) Date of Patent: Jun. 12, 2012

(54) METHOD OF OPERATING A FLUID WORKING MACHINE

(75) Inventors: Onno Kuttler, Dalkeith (GB); Ken Kin-ho Lai, Edinburgh (GB)

(73) Assignees: Sauer-Danfoss ApS, Nordborg (DK); Artemis Intelligent Power Ltd., Midlothian, Scotland (GB)

( * ) Notice: Subject to any disclaimer, the term of this patent is extended or adjusted under 35 U.S.C. 154(b) by 0 days.

(21) Appl. No.: 12/740,810

(22) PCT Filed: Oct. 29, 2008

(86) PCT No.: PCT/DK2008/000384

§ 371 (c)(1), (2), (4) Date: Aug. 12, 2010

(87) PCT Pub. No.: WO2009/056140

PCT Pub. Date: May 7, 2009

(65) Prior Publication Data

US 2010/0296948 A1 Nov. 25, 2010

(30) Foreign Application Priority Data

Nov. 1, 2007 (EP) ..... 07254333

(51) Int. Cl.
*F04B 49/06* (2006.01)
*F04B 7/00* (2006.01)

(52) U.S. Cl. ..... 417/53; 417/505

(58) Field of Classification Search ..... 417/53, 417/505, 290, 247, 423.14, 372, 405, 270, 417/278, 297, 315, 349, 506; 60/445; 251/129.01, 251/129.05, 129.08

See application file for complete search history.

(56) References Cited

U.S. PATENT DOCUMENTS

| | | | |
|---|---|---|---|
| 4,321,014 | A | 3/1982 | Eburn, Jr. et al. |
| 4,815,946 | A | 3/1989 | Cusack |
| 5,046,926 | A | 9/1991 | Deininger et al. |
| 5,186,612 | A | 2/1993 | Budzich |
| 5,190,446 | A | 3/1993 | Salter et al. |
| 5,921,759 | A | 7/1999 | Khan |
| 6,055,851 | A | 5/2000 | Tanaka et al. |
| 6,126,418 | A | 10/2000 | Sinnl |
| 6,283,724 | B1 | 9/2001 | Alaze et al. |
| 6,681,571 | B2 | 1/2004 | Bailey et al. |
| 2004/0105763 | A1 | 6/2004 | Kondo |
| 2006/0039795 | A1 | 2/2006 | Stein et al. |
| 2009/0120086 | A1 | 5/2009 | Kuttler et al. |

FOREIGN PATENT DOCUMENTS

| | | |
|---|---|---|
| DE | 4306377 | 9/1994 |

(Continued)

OTHER PUBLICATIONS

International Search Report dated Feb. 2, 2009 from Serial No. PCT/DK2008/000384.

(Continued)

*Primary Examiner* — Toan Ton
*Assistant Examiner* — Elmito Breval
(74) *Attorney, Agent, or Firm* — McCormick, Paulding & Huber LLP

(57) ABSTRACT

To improve the fluid output flow characteristics (14) of a synthetically commutated hydraulic pump (1), it is suggested to use a plurality of different valve (10) actuation strategies. For every fluid flow demand region I to VI a certain actuation strategy is chosen.

13 Claims, 6 Drawing Sheets

FOREIGN PATENT DOCUMENTS

| | | | |
|---|---|---|---|
| EP | 0361927 | A1 | 4/1990 |
| EP | 0494236 | | 7/1992 |
| EP | 0577783 | | 1/1994 |
| EP | 1319836 | A2 | 6/2003 |
| EP | 1469237 | A1 | 10/2004 |
| EP | 1537333 | | 6/2005 |
| EP | 2055943 | A1 | 6/2009 |
| EP | 2055944 | A1 | 6/2009 |
| EP | 2055945 | A1 | 6/2009 |
| EP | 2055946 | A1 | 6/2009 |
| GB | 968452 | | 9/1964 |
| GB | 1374752 | | 10/1974 |
| WO | 9105163 | A1 | 4/1991 |
| WO | 2004025122 | A1 | 3/2004 |

OTHER PUBLICATIONS

International Search Report dated Feb. 2, 2009 from Serial No. PCT/DK2008/000385.

International Search Report dated Feb. 2, 2009 from Serial No. PCT/DK2008/000382.

International Search Report dated Feb. 2, 2009 from Serial No. PCT/DK2008/000381.

International Search Report dated Feb. 2, 2009 from Serial No. PCT/DK2008/000386.

METHOD OF OPERATING A FLUID WORKING MACHINE

CROSS REFERENCE TO RELATED APPLICATIONS

This application is entitled to the benefit of and incorporates by reference essential subject matter disclosed in International Patent Application No. PCT/DK2008/000384 filed on Oct. 29, 2008 and EP Patent Application No. 07254333.3 filed Nov. 1, 2007.

FIELD OF THE INVENTION

The invention relates to a method of operating a fluid working machine, comprising at least one working chamber of cyclically changing volume, a high-pressure fluid connection, a low-pressure fluid connection and at least one electrically actuated valve connecting said working chamber to said high-pressure fluid connection and/or said low-pressure fluid connection, wherein the actuation pattern of at least one of said electrically commutated valves is chosen depending on the working condition of said fluid working machine. The invention further relates to a fluid working machine, comprising at least one working chamber of cyclically changing volume, a high-pressure fluid connection, a low-pressure fluid connection, at least one electrically actuated valve, connecting said working chamber to said high-pressure fluid connection and/or said low-pressure fluid connection and at least an electronic controller unit.

BACKGROUND OF THE INVENTION

Fluid working machines are generally used, when fluids are to be pumped or fluids are used to drive the fluid working machine in a motoring mode. The word "fluid" can relate to both gases and liquids. Of course, fluid can even relate to a mixture of gas and liquid and furthermore to a supercritical fluid, where no distinction between gas and liquid can be made anymore.

In particular, such fluid working machines are used, if the pressure level of a fluid has to be increased. For example, such a fluid working machine could be an air compressor or a hydraulic pump.

Generally, fluid working machines comprise one or more working chambers of a cyclically changing volume. Usually for each cyclically changing volume, there is provided a fluid inlet valve and a fluid outlet valve.

Traditionally, the fluid inlet valves and the fluid outlet valves are passive valves. When the volume of a certain working chamber increases, its fluid inlet valve opens, while its fluid outlet valve closes, due to the pressure differences, caused by the volume increase of the working chamber. During the phase, in which the volume of the working chamber decreases again, the fluid inlet valve closes, while the fluid outlet valve opens due to the changed pressure differences.

A relatively new and promising approach for improving fluid working machines are the so-called synthetically commutated hydraulic pumps, also known as digital displacement pumps or as variable displacement pumps. Such synthetically commutated hydraulic pumps are known, for example, from EP 0494236 B1 or WO 91/05163 A1. In these pumps, the passive inlet valves are replaced by electrically actuated inlet valves. Preferably the passive outlet valves are also replaced by electrically actuated outlet valves. By appropriately controlling the valves, a full-stroke pumping mode, an empty-cycle pumping mode (idle mode) and a part-stroke pumping mode can be achieved. Furthermore, if both inlet and outlet valves are electrically actuated, the pump can be used as an hydraulic motor as well. If the pump is run as a hydraulic motor, full-stroke motoring and part-stroke motoring is possible as well.

A major advantage of such synthetically commutated hydraulic pumps is their higher efficiency, as compared to traditional hydraulic pumps. Furthermore, because the valves are electrically actuated, the output characteristics of a synthetically commutated hydraulic pump can be changed very quickly.

For adapting the fluid flow output of a synthetically commutated hydraulic pump according to a given demand, several approaches are known in the state of the art.

It is possible to switch the synthetically commutated hydraulic pump to a full-stroke pumping mode for a certain time, for example. When the synthetically commutated pump runs in a pumping mode, a high pressure fluid reservoir is filled with fluid. Once a certain pressure level is reached, the synthetically commutated pump is switched to an idle mode and the fluid flow demand is supplied by the high pressure fluid reservoir. As soon as the high pressure fluid reservoir reaches a certain lower threshold level, the synthetically commutated hydraulic pump is switched on again.

This approach, however, necessitates a relatively large high pressure fluid reservoir. Such a high pressure fluid reservoir is expensive, occupies a large volume and is quite heavy. Furthermore, a certain variation in the output pressure will occur.

So far, the most advanced proposal for adapting the output fluid flow of a synthetically commutated hydraulic pump according to a given demand is described in EP 1 537 333 B1. Here, it is proposed to use a combination of an idle mode, a part-stroke pumping mode and a full-stroke pumping mode. In the idle mode, no effective pumping is done by the respective working chambers during their working cycle. In the full-stroke mode, all of the usable volume of the working chamber is used for pumping fluid to the high-pressure side within the respective cycle. In the part stroke mode, only a part of the usable volume is used for pumping fluid to the high-pressure side in the respective cycle. The different modes are distributed among several chambers and/or among several successive cycles in a way, that the time averaged effective flow rate of fluid through the machine satifies a given demand.

In addition to these previously known controlling methods, different basic controlling strategies can be applied as well. In fact, some additional basic controlling strategies have been conceived by the inventors already. Such additional basic controlling methods will be described in detail in the following.

In the past, synthetically commutated hydraulic pumps were controlled in a way, that a certain basic control strategy has been selected and employed over the whole range of working conditions of the synthetically commutated hydraulic pump. So far, improvements in controlling synthetically commutated hydraulic pumps have been performed by modifying an existing control strategy or by introducing a new basic control strategy and applying the respective idea to the whole range of working conditions of the synthetically commutated hydraulic pump. For example, the controlling method described in EP 1 537 333 B1 is applied for all working conditions of the synthetically commutated hydraulic pump.

Of course, it is straight forward and relatively easy to implement a certain basic control strategy over the whole range of working conditions of a synthetically commutated hydraulic pump. Also, one has to admit, that such a synthetically commutated hydraulic pump already works quite well.

However, so-far proposed methods still have draw-backs and certain limitations. A major issue is the problem of pressure pulsation. Especially under certain working conditions, huge variations in the fluid output flow of the fluid working machine can occur. This results in pressure pulsations, which are unwanted. Such pressure pulsations are noticeable by the operator of a hydraulic machine, powered by the synthetically commutated hydraulic pump. For example, the operator can notice a start-stop-behaviour of a hydraulic cylinder ("stiction" effect). The pressure pulsation can even lead to an increased wear and ultimately to the destruction of components of the hydraulic circuit.

Another problem is the time responsiveness, i. e., the time, the fluid working machine needs after a change in fluid flow demand to adjust its fluid flow output. This time delay can be quite long, especially under certain working conditions. Of course, it is unwanted, that the operator of a machine has to wait for a noticeable time interval, after he has changed the demand.

As an example, the method described in EP 1 537 333 B1 will be further explained. According to this method, a certain, previously defined volume fraction is chosen for the part-stroke pumping. For real applications, the applicant of EP 1 537 333 B1 has chosen a volume fraction of 16.67% (i.e. ⅙). Admittedly, this control method is suited for fluid flow demands in the region below around 15%. However, if the fluid flow demand is very low, say at 2%, the time intervals between two part-stroke pumping pulses are still quite large. The situation is also quite bad in the region slightly above 16.67%, for example at a fluid flow demand of 17%. Here, the fluid flow demand can be either provided by constantly pumping with a 16% part-stroke pumping cycle and inserting a full-stroke pumping stroke in this series with very large time intervals in-between. It would also be possible to abandon the part-stroke pumping in this regime and to satisfy the demand solely using full-stroke pumping cycles. The time intervals between two consecutive pumping cycles will be much smaller. However, noticeable pulsation will still occur.

SUMMARY OF THE INVENTION

It is therefore the object of the invention, to provide a method for operating a fluid flow machine of the synthetically commutated type, which shows an improved fluid flow output characteristics. Furthermore, an appropriate fluid working machine is suggested.

To solve the problem, it is suggested to modify a method of operating a fluid working machine of the aforementioned type in a way, that a plurality of actuation strategies for the actuation of said electrically actuated valve is provided and an appropriate actuation strategy is chosen for different working conditions of said fluid working machine.

When trying to overcome the already described problems, the inventors started to work on improvements on the previously known actuation strategies for synthetically commutated hydraulic pumps. Doing this, they conceived several modifications and even developed some previously not known actuation strategies for synthetically commutated hydraulic pumps. Doing this, they surprisingly figured out that it is very hard, if not impossible, to optimise a single actuation strategy in a way, that said single actuation strategy provides a good fluid flow output characteristic under all working conditions of the fluid working machine. Instead, each single actuation strategy usually shows a good performance within one or several intervals of different working conditions of the fluid working machine, while the performance is bad in different regions (interval of working conditions). Moreover, they surprisingly figured out, that the regions, where the different actuation strategies show a good performance, are not necessarily the same. Therefore, by choosing an appropriate actuation strategy within each region of possible working conditions of the fluid working machine, the fluid output characteristics of the fluid working machine can be improved. The thus combined fluid output characteristics of different actuation strategies can be much better than what a single actuation strategy can ever provide.

Of course, in order to realise that different actuation strategies show good results in different regions of working conditions, it was necessary to first develop a plurality of different basic actuation strategies. Particularly, this was necessary, because the knowledge of controlling methods for synthetically commutated hydraulic pumps was too limited beforehand.

It has to be noted, that the invention can be used not only for hydraulic pumps. Instead, it is also usable, if the fluid working machine is used as a hydraulic motor. In this case, of course, the fluid flow demand is normally replaced by the demand of mechanical power and/or the availability of hydraulic fluid on the high pressure side. Also, in this case the notion pumping stroke has to be understood as a motoring stroke, of course.

Preferably, the working condition of the fluid working machine is at least in part defined by different fluid flow demands. The fluid flow demand is usually the main input parameter for controlling a fluid flow machine. The fluid flow demand is usually given by the operator of a machinery, who is using the fluid working machine. The operator can choose the fluid flow demand by setting a command (for example a joy-stick, a pedal, a throttle, a lever, the engine speed or the like) to a certain level. The fluid flow demand is therefore usually the parameter which changes most. However, different parameters can define the working condition as well. For example, the driving speed of the fluid flow machine (revolutions per minute of the rotating axis), the mechanical power consumed by other components, which are driven by the same mechanical power source as the fluid working machine, the temperature of the hydraulic oil, the pressure, the availability of mechanical power or the like can be used instead and/or additionally as input parameters.

Preferably, at least one of said actuation strategies is a variable part-stroke strategy. This variable part-stroke strategy can be achieved by using a continuous series of part-stroking pumping pulses. Within this series, the pumping fraction of an individual pumping cycle can be chosen, depending on the actual fluid flow demand. The variation of the pumping fraction is normally done by an appropriate variation of the firing angle (actuation angle, actuation time, firing time) of the inlet valve.

The variable part-stroke strategy can be particularly useful for low fluid flow demands and/or high fluid flow demands. In these regions, a variable part-stroke strategy can usually provide for the smoothest fluid flow output with the least time spacing between pulses. As an estimate for the low fluid flow demand region the interval from 0 to 10% can be used. However, the interval from 0 to 5, 6, 7, 8, 9, 11, 12, 13, 14, 15, 16.7 (i.e. ⅙), 20, 25, 30, 33.3% (i.e. ⅓) or 35% fluid flow demand can be used. On the high fluid flow side, the interval can be analogously chosen to vary from 65, 66.7 (i.e. ⅔), 70, 75, 80, 83.3 (i.e. ⅚), 85, 86, 87, 88, 89, 90, 91, 92, 93, 94, 95 to 100%. Of significance could be also ⅓, ¼, ⅕, ⅙ . . . and ⅔, ¾, ⅘, ⅚, . . . (i.e.

$$\frac{1}{n} \text{ and } \frac{n-1}{n}$$

for n=3, 4, . . . ).

It has to be mentioned, that an upper limit for the low fluid flow demand region and/or a lower limit for the high fluid flow demand region can stem from the fact, that in the middle region of fluid flow demands, the fluid inlet valve had to be closed when the speed of the fluid, passing through the fluid inlet valve can be very high. The speed of the fluid, passing through the fluid inlet valves is particularly dependent on the geometrical set-up of the pump, the driving speed of the pump and the cylinder's working phase. A high fluid speed can be particularly present, if the fluid flow machine is of a piston and cylinder type, is used at high speeds (rpm) and/or the working phase is around 90° past the bottom dead center. Closing the inlet valve in such a region can lead to an increased stress of the valve and/or to an increased generation of noise.

It is also possible to exclude the variable part stroke strategy for very low fluid flow demands. Theoretically, even in this very low fluid flow demand region the variable part stroke strategy can still deliver the smoothest possible fluid flow. However, the inventors surprisingly found that the application of variable part stroke strategy can be problematic in the very low fluid flow demand region. This is, because variable part stroke strategy would generate a pulsating flow of small pumping strokes at a high frequency. The resulting pressure pulsations are dampened through components such as hoses and accumulators. However, a higher pulsation frequency will induce more vibration in stiffer components such as hoses. Therefore, heat is generated from internal friction in these components, as they endure vibration, not typical for the application of such component. A second effect in addition to the increased heat generation is that the heat cannot be transferred away quickly enough, since the flow rate is very low in this region. This can lead to a build-up of excess heat, which can result in severely high temperatures, which can even destroy some components such as hoses. It has to be noted, that the heat, generated in a hose, is proportional to the rate of change of pressure, which itself is function of both the amplitude and the frequency of the pressure ripple.

I.e., $$Q_{Hose} \propto \frac{dp}{dt} = f(p_{Peak\text{-}to\text{-}Peak}, f)$$

where $Q_{Hose}$ is the heat generated in the hose, $p_{Peak\text{-}to\text{-}Peak}$ is the peak-to-peak pressure ripple and f is the frequency of the pressure ripple. Therefore, in the very low fluid flow region, it is preferred to use a different pumping (motoring) strategy, for example mixed pattern modulation strategy, as described later on. Although, this will usually result in higher pressure changes, the frequency of the pressure ripples can occur at a much lower frequency, therefore preventing overheating of components. The very low fluid flow demand region can be defined as the interval from 0 to 1, 2, 3, 4, 5, 6 or 7%.

Advantageously, at least one of the actuation strategies is a mixed pattern modulation strategy. Here, a series of at least two pumping cycles of different volume pumping fractions are combined in a way, that on the time average, the actual fluid flow output corresponds to the fluid flow demand. Of course, a pumping fraction of 0% (idle stroke pumping cycle) and/or a pumping fraction of 100% (full-stroke pumping cycle) can be used for this purpose as well. If a mixture of idle stroke pumping cycles, full-stroke pumping cycles and part-stroke pumping cycles with 16% volume fraction is used, this is equivalent to the method described in EP 1 537 333 B1. However, it is presently suggested, that the volume fraction of the part stroke pumping cycle is varied according to the working condition of the fluid working machine, at least within a certain region. The variation according to the working condition of the fluid working machine is preferably done dynamically with the relatively simple predefined sequence of part-stroke pulses. The region for the application of mixed pattern modulation strategy is preferably the middle region, the medium/low region and/or the medium high region.

It is even more preferred, if at least two different part-stroke pumping cycles with different pumping fractions are used for different working conditions of the fluid working machine. The pumping fractions can be chosen depending on the fluid flow demand. In other words, not only a single part-stroke pumping cycle (i. e. not an idle-stroke or full-stroke pumping cycle) with a single pumping volume fraction is used. Instead, different volume fractions can be used for different part-stroke pumping cycles. As an example, a series of 25 and 75% volume fraction (and, if necessary of idle stroke and/or full-stroke pumping cycles) can be composed in a way, that the actual fluid flow demand is satisfied. The given numbers of 25% and 75% are of course examples and can be chosen differently, as well. In particular, it is even preferred to vary the volume fractions depending on the actual fluid flow demand. Therefore, the pumping fraction with a lower number can be chosen from the interval between 0% and 25% fractional pumping volume. Of course the interval boundaries could lie between 0% and 10%, 11%, 12%, 13%, 14%, 15%, 16%, 16.7%, 17%, 18%, 19%, 20%, 21%, 22%, 23%, 24%, 26%, 27%, 28%, 30%, 33.3% or 35% as well. Likewise, the higher fractional volume can be chosen from the interval between 75% and 100%. The interval can also run from 65%, 66.7%, 70%, 71%, 72%, 73%, 74%, 76%, 78%, 79%, 80%, 81%, 82%, 83%, 83.3%, 84%, 85%, 86%, 87%, 88%, 89%, 90% to 100%. Likewise, $$\frac{1}{n} \text{ and } \frac{n-1}{n}$$

for n=3, 4, 5, 6, . . . could be used as well, respectively.

It is also preferred, if at least one of the actuation strategies is a set of pre-calculated actuation patterns. An actuation pattern can, in principle, be any series of no stroke pumping cycles (idle mode), part-stroke pumping cycles (of any fractional value) and/or full-stroke pumping cycles. However, the series of different pumping cycles is not determined by on-the-fly calculations, using an "accumulator" variable, being representative of the fluid flow demand and the actual pumping performance. Instead, the series of different actuation patterns is calculated in advance. Then, depending on the actual fluid flow demand, an appropriate pre-calculated actuation pattern is chosen. This precalculated actuation pattern will usually be the one, which satisfies the demand best, given the actual working conditions of the fluid working machine. When pre-calculating the actuation pattern, a plethora of conditions can be considered and accounted for in the actuation patterns. For example, the actuation patterns can be pre-calculated in a way to achieve a smooth fluid flow output, so that the resulting pressure pulsations can be minimised. Furthermore, when pre-calculating the actuation patterns, anti-aliasing methods can be used, to avoid numerical artefacts (Moiré-effect). With presently available memory devices, a huge set of pre-calculated actuation patterns can be stored inexpensively. This way, a sufficient amount of different pre-calculated actuation patterns for satisfying different fluid flow demands can be provided.

Preferably, for a fluid flow demand, lying between two pre-calculated actuation patterns, an interpolation of the neighbouring pre-calculated actuation patterns is used. Using this, the amount of different actuation patterns to be stored can be limited, but still a very good fine tuning is possible. The interpolation is normally done by an appropriate series, where said neighbouring actuation patterns are following each other in time. If, for example, an actuation pattern is stored for a 14% demand and for a 15% demand, and the actual fluid flow demand is 14.1%, the 14.1% demand can be satisfied on the long run, when a series of a single 14% actuation pattern and a following group of nine actuation patterns with 15% volume fraction is performed. Of course, it is also possible to simply "round" the fluid flow demand to the next value, for which an actuation pattern is stored. This is particularly not a problem, if a relatively huge number of pre-calculated actuation patterns is stored.

Preferably, for medium low fluid flow demands and/or for medium high fluid flow demands, mixed-pattern modulation strategy and/or pre-calculated actuation pattern strategy is chosen. As an example, the respective actuation strategy could be used for fluid flow demands, lying in the interval between 10% and 25% and/or between 75% and 90%. However, different numbers could be used as well. For the lower limit of the medium low fluid flow demand and the upper limit of the medium high fluid flow demand interval, reference is made to the upper limit of the low fluid flow demand and the lower limit of the high fluid flow demand of the variable part stroke strategy, respectively.

As the upper limit for the medium low fluid flow demand interval and the lower limit of the medium high fluid flow demand interval, 15%, 16.7%, 20%, 21%, 22%, 23%, 24%, 26%, 27%, 28%, 29%, 30%, 33.3%, 35%, 40%, 60%, 65%, 66.7%, 70%, 71%, 72%, 73%, 74%, 76%, 77%, 78%, 79%, 80%, 83.3% and/or 85% could be used as well. Once again, $$\frac{1}{n} \text{ and } \frac{n-1}{n}$$

for n=3, 4, 5, 6, 7, . . . could be used as well.

It is also preferred, if for a medium fluid flow demand, pre-calculated actuation pattern strategy and/or mixed pattern actuation strategy is chosen. Particularly in this region, even when considering certain limitations for the allowed volume fraction for part-stroke pumping cycles, different fluid output flows can be achieved with very short interval lengths of the actuation patterns in case pre-calculated actuation patterns are used. An interval between 25 and 75% could be defined, where the respective actuation strategy is used. However, 10%, 15%, 16.7%, 20%, 21%, 22%, 23%, 24%, 26%, 27%, 28%, 29%, 30%, 33.3%, 35%, 40%, 45%, 55%, 60%, 65%, 66.7%, 70%, 71%, 72%, 73%, 74%, 76%, 77%, 78%, 79%, 80%, 83.3%, 85%, 90% could be used as the lower and/or upper interval limit, respectively. Once again, $$\frac{1}{n} \text{ and } \frac{n-1}{n}$$

for n=3, 4, 5, 6, 7 . . . can be used here as well, respectively.

It is further preferred, if the limits for the allowed region of individual part-stroke pumping cycles and/or the limits for the transition between different actuation strategies are chosen depending on the working condition, particularly depending on the turning speed of the fluid working machine. The "allowed region" of the individual part-stroke pumping cycles is the interval of fractional volumes, the fractional pumping cycles may be chosen from. In other words, the "allowed region" is defined by considering the speed of the hydraulic fluid passing through the fluid inlet valve at the actuation angle of said fluid inlet valve. If the speed of the hydraulic fluid, passing through the inlet valve at the (intended) actuation angle is higher than a certain limit, the actuation is forbidden; while the actuation is allowed if the speed is below said limit. The driving speed (e.g. revolutions per minute) of a fluid working machine, for example, is such a factor that influences the speed of the fluid passing through the inlet valves. Therefore, at lower driving speeds of the fluid working machine, the region of allowed volume fractions for the individual part-stroke pumping cycles can be extended, without inducing increased stress, wear and/or increasing noise generation.

Accordingly, the region, where the variable part-stroke strategy is applied, can be extended. Of course, different parameters can be considered as well, like the temperature of the hydraulic fluid, which is an indication for the viscosity of the hydraulic fluid. In any case, the fluid output characteristics and the consistency of fluid output characteristics in different working conditions can be further improved.

Furthermore, a fluid working machine of the aforementioned type is suggested, which is characterised in that the electronic controller unit is designed and arranged in a way, that the electronic controller unit performs a method according to at least one of the previously described embodiments.

The objects and advantages of the respective embodiments of the fluid working machine are analogous to the respective embodiments of the described method.

BRIEF DESCRIPTION OF THE DRAWINGS

The invention will become clearer when considering the following description of embodiments of the present invention, together with the enclosed figures.

The figures are showing.

DETAILED DESCRIPTION OF THE PREFERRED EMBODIMENTS

Figure 1:
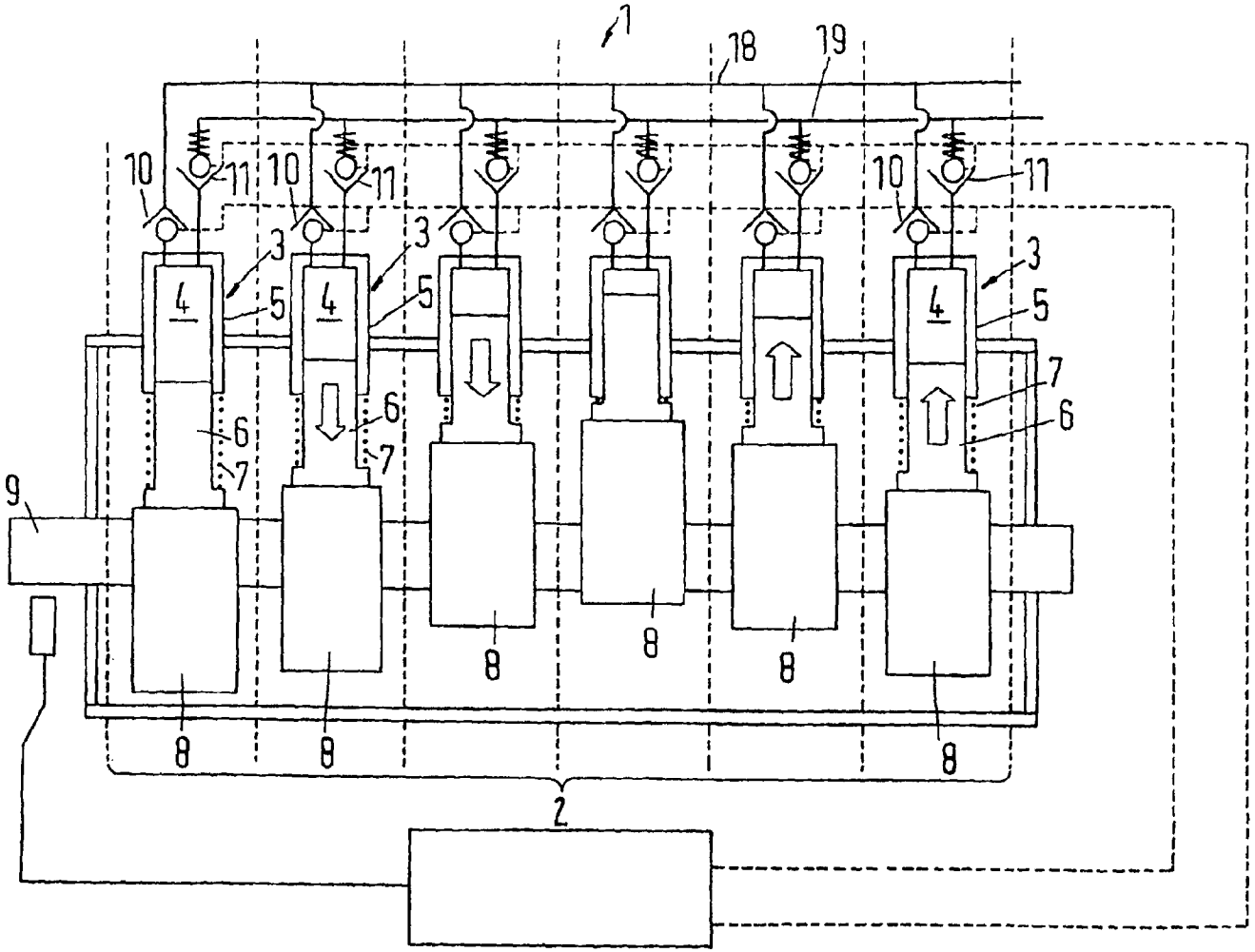
FIG. 1: shows a schematic diagram of a synthetically commutated hydraulic pump with six cylinders.

In FIG. 1, an example of a synthetically commutated hydraulic pump 1, with one bank 2, having six cylinders 3 is shown. Each cylinder has a working space 4 of a cyclically changing volume. The working spaces 4 are essentially defined by a cylinder part 5 and a piston 6. A spring 7 pushes the cylinder part 5 and the piston 6 apart from each other. The pistons 6 are supported by the eccentrics 8, which are attached off-centre of the rotating axis of the rotatable shaft 9. In the case of a conventional radial piston pump ("wedding-cake"-type pump), multiple piston 6 can also share the same eccentric 8. The orbiting movement of the eccentric 8 causes the pistons 6 to reciprocally move in and out of their respective cylinder parts 5. By this movement of the pistons 6 within their respective cylinder parts 5, the volume of the working spaces 4 is cyclically changing.

In the example shown in FIG. 1, the synthetically commutated hydraulic pump 1 is of a type with electrically actuated inlet valves 10 and electrically actuated outlet valves 11. Both inlet valves 10 and outlet valves 11 are fluidly connected to the working chambers 4 of the cylinders 3 on one side. On their other side, the valves are fluidly connected to a low pressure fluid manifold 18 and a high pressure fluid manifold 19, respectively.

Because the synthetically commutated hydraulic pump 1 comprises electrically actuated outlet valves 11, it can also be used as a hydraulic motor. A valve, which is used as an inlet valve during pumping mode, will become an outlet valve during motoring mode and vice versa.

Of course, the design could be different from the example shown in FIG. 1, as well. For example, several banks 2 of cylinders could be provided. It's also possible that one or several banks 2 show a different number of cylinders, for example four, five, seven and eight cylinders 3. Although in the example shown in FIG. 1, the cylinders 3 are equally spaced within a full revolution of the shaft 9, i. e. 60° out of phase from each other, the cylinders 3 could be spaced unevenly, as well.

Of course, not only piston and cylinder pumps are possible. Instead, other types of pumps can take advantage of the invention as well.

Figure 2:
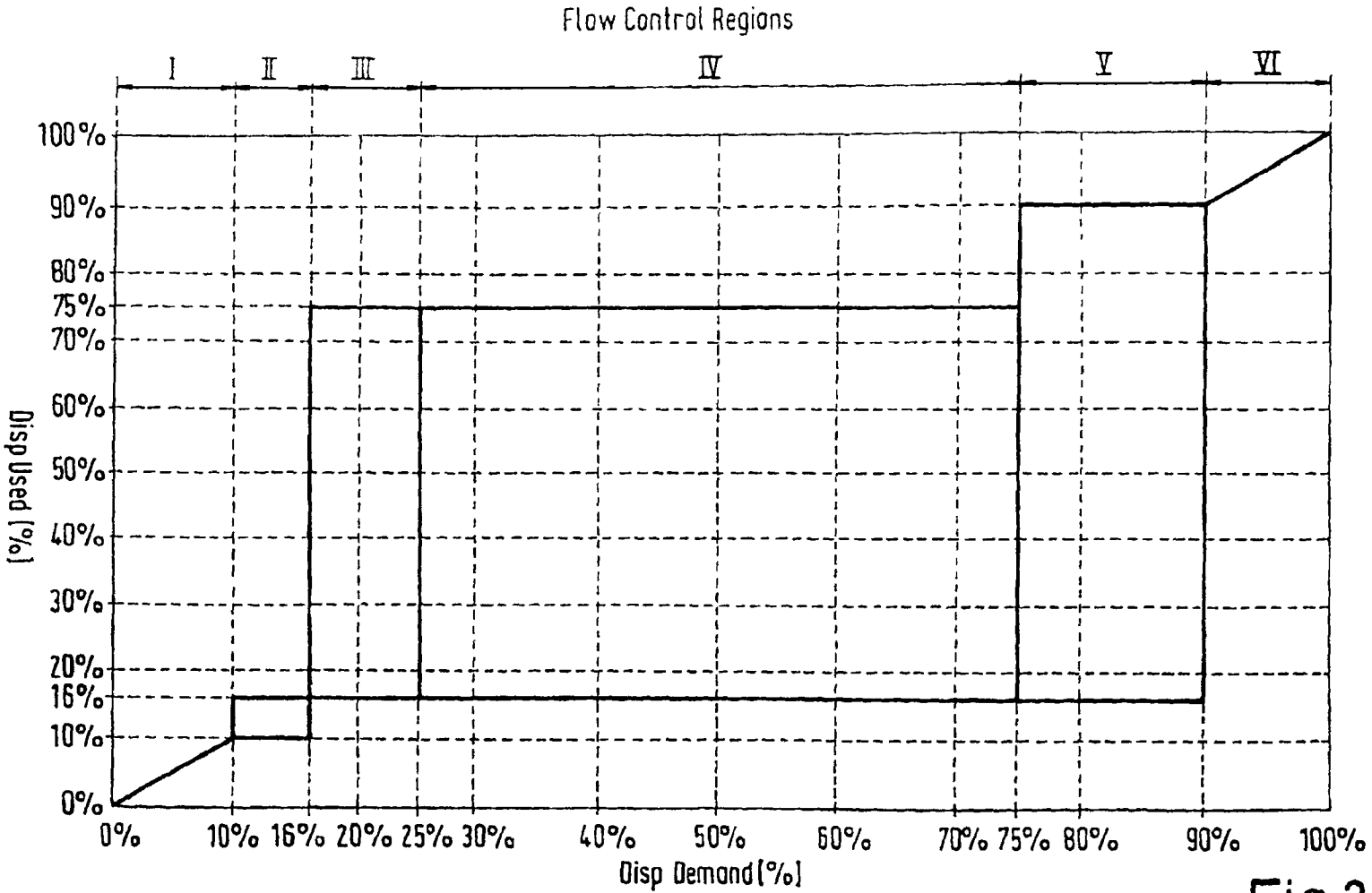
FIG. 2: illustrates the composition of different actuation strategies according to an embodiment of the invention.

In FIG. 2 a possible embodiment of the invention is shown, as an example. In FIG. 2 six different actuation regimes I to VI are indicated. The meanings of the different actuation regimes I to VI are also listed in table 1. Within each region, a certain actuation regime is performed.

If the fluid flow demand is very low (i. e. in region I with fluid flow demand between 0% and 10%) or very high (i. e. in region VI with fluid flow demand between 90% and 100%), the variable part-stroke actuation strategy is applied in the current example.

Figure 3:
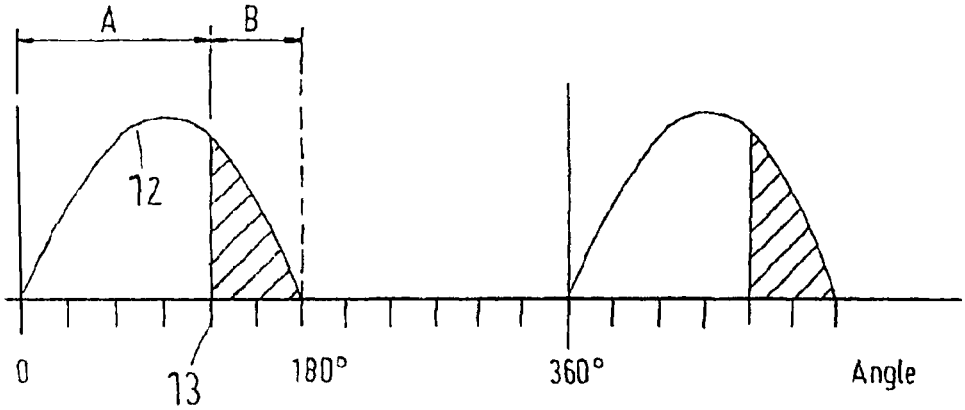
FIG. 3: illustrates the part-stroke pumping concept.
Figure 4:
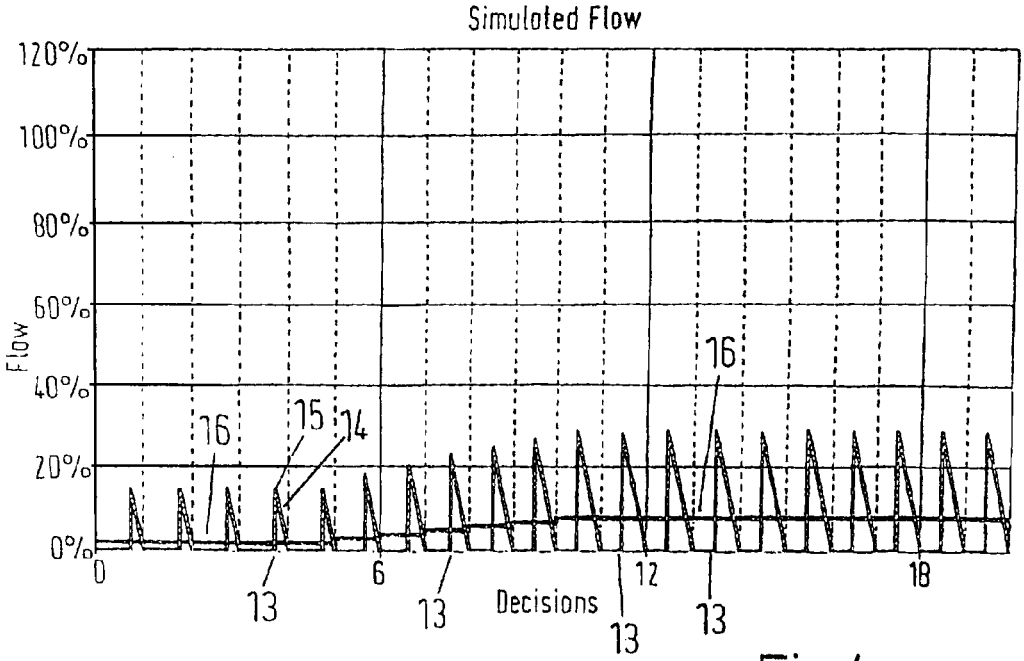
FIG. 4: shows a fluid flow output using a variable part-stroke strategy in the low fluid flow demand region.
Figure 5:
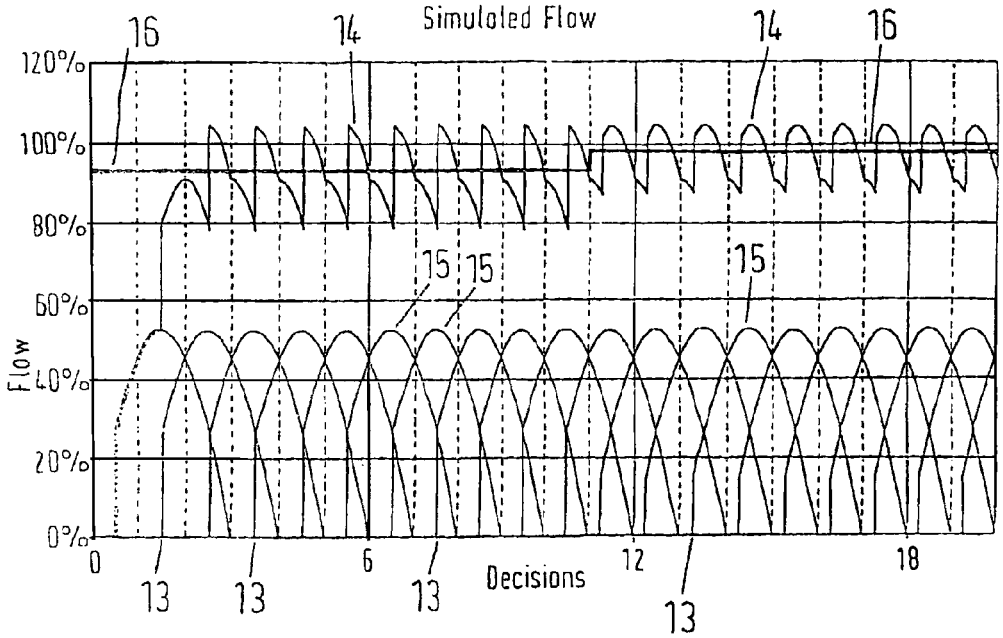
FIG. 5: shows a fluid flow output using a variable part-stroke strategy in the high fluid flow demand region.

The variable part-stroke strategy will be further explained using FIGS. 3 to 5.

In FIG. 3 the fluid output flow 12 of a single cylinder 3 is illustrated. In FIG. 3 a tick on the abscissa indicates a turning angle of 30° of the rotatable shaft 9. At 0° (and at 360°, 720° etc.) the working chamber 4 of the respective cylinder 3 starts to decrease in volume. In the beginning, the electrically actuated inlet valve 10 remains in its open position. Therefore, the fluid, being forced outwards of the working chamber 4 will leave the cylinder 3 through the still open inlet valve 10 towards the low pressure fluid manifold. Therefore, in time interval A, a "passive pumping" is done. I. e., the fluid entering and leaving the cylinder 3 is simply moved back to the low pressure fluid manifold 18, and no effective pumping to the high pressure side is performed. In the example shown in FIG. 3, the firing angle 13 is chosen to be at 120° rotation angle of the rotable shaft 9 (and likewise 480°, 840°, etc.). At firing angle 13, the electrically actuated valve 10 is closed by an appropriate signal. Therefore, the remaining fluid in working chamber 4 cannot leave the cylinder 3 via the inlet valve 10 anymore. Therefore, pressure builds up, which will eventually open the outlet valve 11 and push the fluid towards the high pressure manifold. Therefore, time interval B can be expressed as an "active pumping" interval (as opposed to a "passive pumping" interval). Once the piston 6 has reached its top dead center (or slightly afterwards) at 180° (540°, 900° etc.), outlet valve 11 will close under the influence of the valve's closing spring while the inlet valve 10 is opened by the underpressure generated in the working chamber 4 by the piston 6 moving downwards. Now the expanding working chamber 4 will suck in hydraulic fluid via inlet valve 10. In the example of FIG. 3, an effective pumping of 25% of the available volume of working chamber 4 is performed.

In FIGS. 4 and 5 examples of the fluid flow output using variable part-stroke strategy are shown for fluid flow demands 16 in the low demand region (FIG. 4) and the high demand region (FIG. 5). On the abscissa, so-called "decisions" are shown indicating the beginning of the contraction of one of the cylinders. One tick on the abscissa represents a 60° turning angle of the rotatable shaft 9.

In FIG. 4, the fluid flow demand 16 starts with 2%. As can be seen from FIG. 4, this fluid flow demand is supplied by a series of a single part-stroke pulses 15. For each part-stroke pulse 15, the firing angle 13 is chosen in a way, that the average flow produced and pumped to the high pressure side is equivalent to 2% of the pump capacity (the working chambers displacement). Beginning with decision point 5, the fluid flow demand 16 is slowly increased to a fluid flow demand of 8% (at decision point 10). As can be deferred from FIG. 4, the firing angle 13 is advanced accordingly, so that the individual part-stroke pulses 15 will provide a higher output volume fraction, corresponding to the increased fluid flow demand 16.

In FIG. 5, the situation on the high end side of the fluid flow demand scale is shown. The fluid flow demand 16 starts at 93% fluid flow demand, and increases at decision point 11 to a fluid flow demand 16 of 98%. Initially, the fluid flow demand 16 of 93% volume fraction is supplied by a series of individual part-stroke pumping cycles 15. Initially, the respective firing angles 13 are chosen in a way, that the outputted fluid volume fraction of an individual pumping pulse 15 corresponds to the initial fluid flow demand 16 of 93%. Because an individual part-stroke pulse 15 takes almost 180° to complete (i. e. three decision points) the individual pumping pulses 15 overlap each other. Using a six cylinder 3 synthetically commutated hydraulic pump 1 (see FIG. 1), up to three individual pulses 15 overlap each other. The total fluid flow output is shown in FIG. 5 by line 14.

As already mentioned, at decision point 11, the fluid flow demand 16 is increased to 98%. Hence, the firing angle 13 of the individual pumping pulses 15 is shifted in a way, so that the outputted volume fraction of each individual pumping pulse 15 corresponds to the increased fluid flow demand 16 of 98%. Likewise, the total fluid output flow 14 increases.

In fluid flow demand regions II; III and V of FIG. 2 (see also table 1), the fluid flow demand is satisfied by a pre-calculated actuation pattern.

Figure 6:
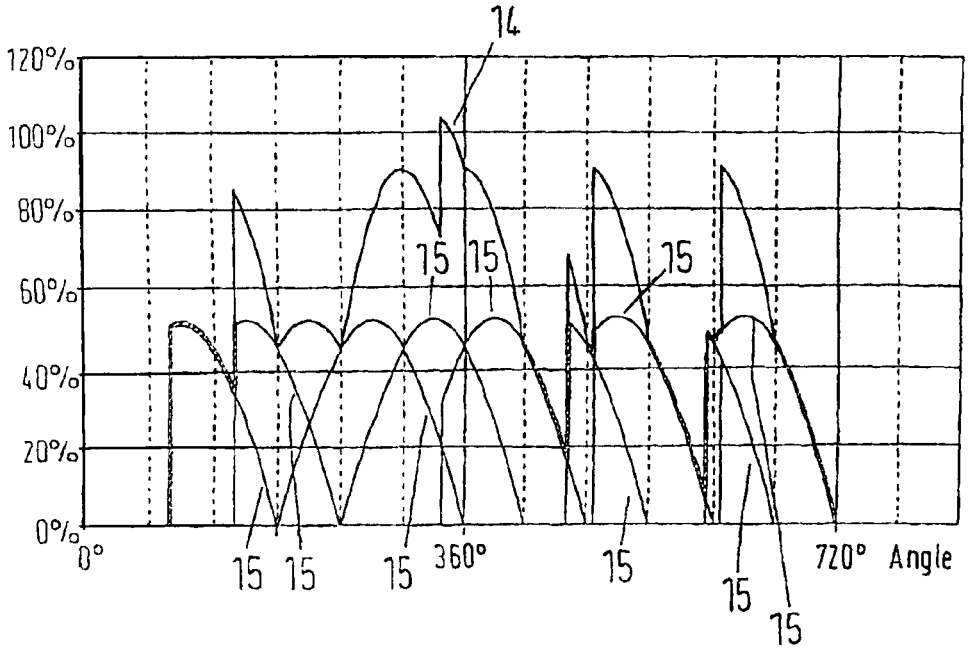
FIG. 6: illustrates, how an output flow is generated by the individual output flows of several cylinders.

FIG. 6 illustrates, how a series of single pulses 15 of different volume fractions (including full stroke pulses and no-stroke/idle pulses) can be combined to generate a certain total output flow 14. By choosing an actuation pattern, wherein the number of pumping cycles as well as the pumping volume fraction of each individual pumping stroke 15 can be varied, an almost arbitrary output fluid flow rate can be achieved on the time average. The total fluid output flow 14 of FIG. 6 is not necessarily a fluid output flow pattern which is likely to occur in practical applications. However, it is illustrating how a plurality of pumping pulses, each with different volume fractions and starting at different times will sum up to a total fluid output flow of a certain shape.

Figure 7:
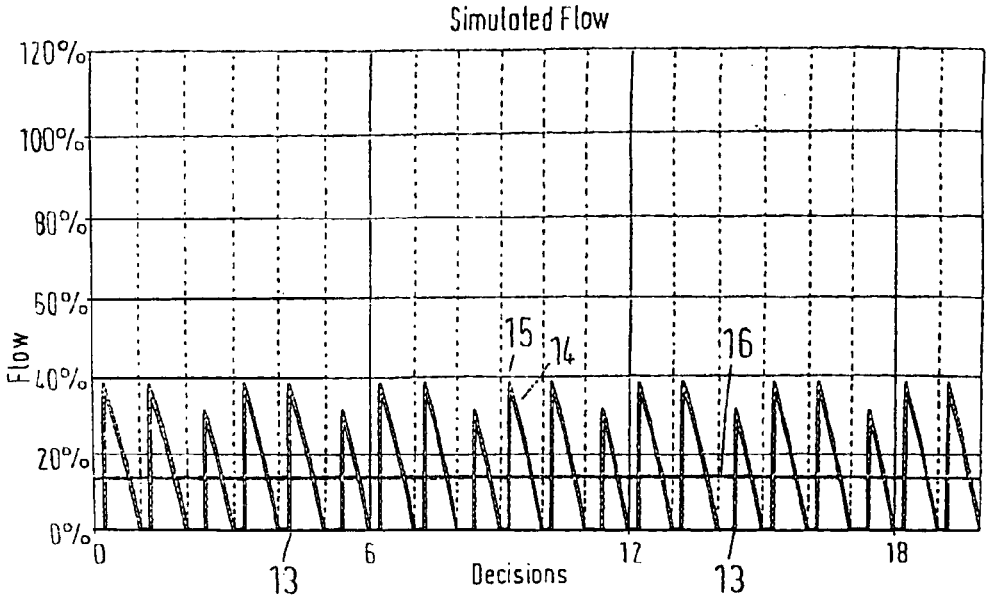
FIG. 7: illustrates the fluid flow output, using a pre-calculated actuation pattern strategy in the mid low fluid flow demand region.

In FIG. 7 an example for region II of FIG. 2/table 1 is shown. Here, a fluid flow demand 16 of 14% is assumed. As indicated in table 1,this fluid flow demand 16 will be provided by using a sequence of 10% and 16% part-stroke fractions. A very simple sequence to achieve this is (16%, 16%, 10%). As soon as this basic sequence is completed, it will be repeated. This repeated sequence is shown in FIG. 7. The basic features (i. e. axis notations) of FIG. 7 are the same as in FIGS. 4 to 6.

Figure 8:
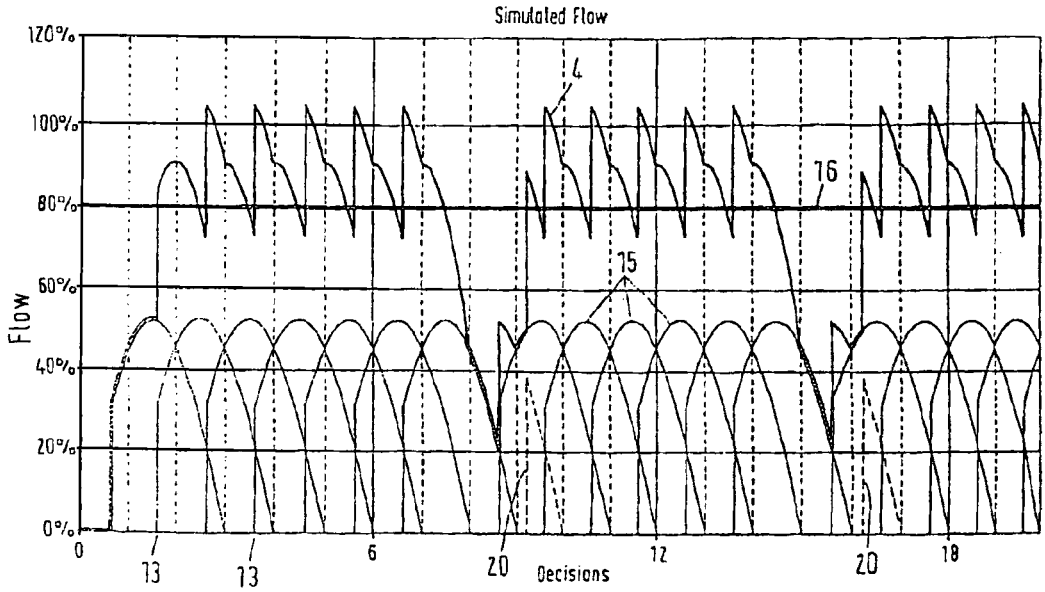
FIG. 8: illustrates the fluid flow output, using a pre-calculated actuation pattern strategy in the mid high fluid flow demand region.

In FIG. 8, an example for region V (FIG. 2; table 1) is shown. A fluid flow demand of 80% is used in the example. In the example shown, this fluid flow demand will be provided by a sequence, composed of 16% and 90% part-stroke pulses. A possible basic sequence to satisfy this demand can be:

90%+90%+90%+90%+90%+90%+90%+16%+90%+
90%+90%+90%+90%+90%+16%+90%+90%+
90%+90%+90%+90%+90%+16%+90%+90%+
90%+90%+90%+90%+16%+90%+90%+90%+
90%+90%+90%+16%

This basic sequence will be repeated, once the previous cycle is completed. This sequence is illustrated in FIG. 8. However, for illustrative purposes, not the complete cycle is shown. However, it can still be seen, how the individual pumping cycles 15 will add up to the total fluid flow output 14.

As can be seen from FIG. 8, in the time interval between decision point 7 and decision point 8, no 16%-part stroke pulse 20 is visible. Instead, said 16%-part stroke pulse 20 is performed in the time interval between decision point 9 and 10. This is because of the "blocking" of the previous cylinders of the pump. Because all contracting cylinders (starting with decision point 0) are involved with pumping, no cylinder is available for a 16%-part stroke pulse pumping between decision points 7 and 9 anymore. The first cylinder available for such a 16%-part stroke pumping is the cylinder, starting to contract at decision point 7. Indeed, this cylinder will perform the 16%-part stroke pumping pulse 20 in the time interval between decision points 9 and 10.

If a pumping cycle (part-stroke or full-stroke) is performed, an appropriate value is subtracted from the accumulator value 14 in this step.

Figure 9:
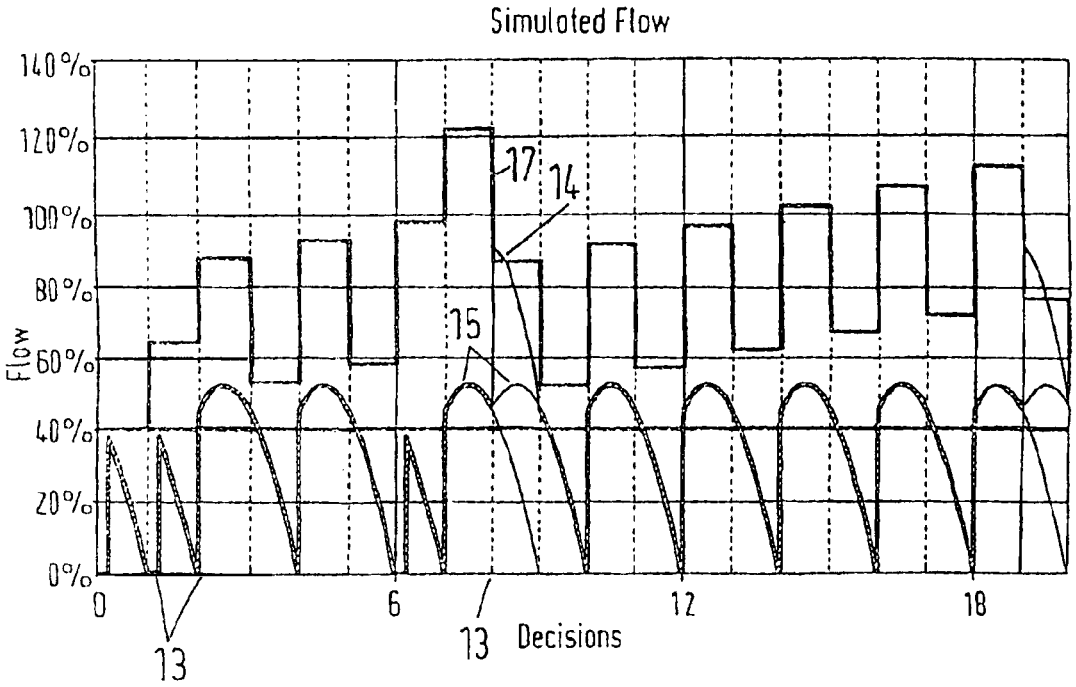
FIG. 9: illustrates the fluid flow output, using an online actuation strategy in the medium fluid flow demand region.

The development of the accumulator variable over time is further illustrated in table 2, for the example shown in FIG. 9.

The column "decision" in Table 2 stands for the time, when an actual decision is made to perform a pumping cycle (in Table 2 16%-part stroke cycles and 75%-part stroke cycles). The time, when the actual part stroke pumping is performed, can vary in time, depending on the actual design of the pump, the fluid flow demand and the previously performed pumping cycles. In other words, the same situation as in the previously described FIG. 8 can occur here as well.

Additional information can be drawn from the other three applications, filed on the same day by the same applicant under EP Application Serial No. 07254337.4,EP Application Serial No. 07254332.5 and EP Application Serial No. 07254331.7. The contents of said applications are included into the disclosure of this application by reference. Also, U.S. application Ser. No. 12/261,390 is incorporated by reference herein.

While the present invention has been illustrated and described with respect to a particular embodiment thereof, it should be appreciated by those of ordinary skill in the art that various modifications to this invention may be made without departing from the spirit and scope of the present.

TABLE 1

| Region | Range | | Description |
|---|---|---|---|
| I | 0% | 10% | VPS from 0% to 10% |
| II | 10% | 16% | Pre-calculated actuation sequence with 10% and 16% part stroke fractions |
| III | 16% | 25% | Pre-calculated actuation sequence with 16% and 75% part stroke fractions |
| IV | 25% | 75% | Online algorithm with 16% and 75% part stroke fractions |
| V | 75% | 90% | Pre-calculated actuation sequence with 16% and 90% part stroke fractions |
| VI | 90% | 100% | VPS from 90% to 100% |

TABLE 2

| Decision Point | Flow Demand | Accumulator | Decision | Updated Accumulator |
|---|---|---|---|---|
| 1 | 40% | 0% + 40% = 40% | 16% < 40% ≦ 75% = >16% cycle | 40% − 16% = 24% |
| 2 | 40% | 24% + 40% = 64% | 16% < 64% ≦ 75% = >16% cycle | 64% − 16% = 48% |
| 3 | 40% | 48% + 40% = 88% | 88% ≧ 75% = >75% cycle | 88% − 75% = 13% |
| 4 | 40% | 23% + 40% = 63% | 16% < 53% < 75% = >16% cycle | 53% − 16% = 37% |
| 5 | 40% | 37% + 40% = 77% | 77% ≧ 75% = >75% cycle | 77% − 75% = 2% |
| 6 | 40% | 3% + 40% = 43% | 16% < 43% ≦ 75% = >16% cycle | 43% − 16% = 27% |
| 7 | 40% | 27% + 40% = 67% | 16% < 67% ≦ 75% = >16% cycle | 67% − 16% = 51% |
| 8 | 40% | 51% + 40% = 91% | 91% ≧ 75% = >75% cycle | 91% − 75% = 16% |
| 9 | 40% | 16% + 40% = 56% | 16% < 56% ≦ 75% = >16% cycle | 56% − 16% = 40% |
| 10 | 40% | 40% + 40% = 80% | 80% > 75% = >75% cycle | 80% − 75% = 5% |

In region IV of FIG. 2 and table 1, an online algorithm is used as an actuation strategy.

As an example for region IV, a fluid flow demand of 40% is chosen, which has to be fulfilled by 16% and 75% part-stroke pumping pulses. The fluid output flow is shown in FIG. 9. In addition to the single pumping pulses 15, the total output fluid flow 14 and the fluid flow demand 16, a curve, showing the value of the accumulator 17 is shown. The accumulator 17 is a variable, indicating the differences between fluid flow demand 16 and actual fluid flow output 14. In every step, the fluid flow demand 16 is added to the accumulator variable 14.

What is claimed is:

1. A method of operating a fluid working machine, comprising at least one working chamber of cyclically changing volume, a high-pressure fluid connection, a low-pressure fluid connection and at least one electrically actuated valve connecting said working chamber to said high-pressure fluid connection and/or said low-pressure fluid connection, wherein the actuation pattern of at least one of said electrically actuated valves is chosen by an actuation strategy, depending on the working condition of said fluid working machine, wherein a plurality of different actuation strategies for the actuation of said electrically actuated valve is provided and an appropriate actuation strategy is chosen for different working conditions of said fluid working machine.

2. The method according to claim 1, wherein the working condition of the fluid working machine is at least in part defined by different fluid flow demands.

3. The method according to claim 1, wherein at least one of said different actuation strategies is a variable part stroke strategy.

4. The method according to claim 3, wherein said variable part stroke strategy is used for fluid flow demands below 35% and/or fluid flow demands above 65%.

5. The method according to claim 3, wherein said variable part stroke strategy is excluded for fluid flow demands below 7%.

6. The method according to claim 1, wherein at least one of said different actuation strategies is a mixed pattern modulation strategy.

7. The method according to claim 6, wherein at least two different part stroke pumping cycles with different pumping fractions are used for different working conditions of said fluid working machine.

8. The method according to claim 6, wherein at least one of said different actuation strategies is a set of pre-calculated actuation patterns.

9. The method according to claim 8, wherein for a fluid flow demand, lying between two pre-calculated actuation patterns, an interpolation of the neighbouring pre-calculated actuation patterns is used.

10. The method according to claim 6, wherein for fluid flow demands between 10% and 40% and/or fluid flow demands between 60% and 90%, mixed pattern modulation strategy and/or pre-calculated actuation pattern strategy is chosen.

11. The method according to claim 6, wherein for fluid flow demands between 20% and 80% pre-calculated actuation pattern strategy and/or mixed pattern modulation strategy is chosen.

12. The method according to claim 1, wherein the limits for the interval of fractional volume for individual part-stroke pumping cycles and/or the limits for the transition between different actuation strategies are chosen depending on the working condition, particularly depending on the turning speed of the fluid working machine.

13. A fluid working machine, comprising at least one working chamber of cyclically changing volume, a high-pressure fluid connection, a low-pressure fluid connection, at least one electrically actuated valve connecting said working chamber to said high-pressure fluid connection and/or said low-pressure fluid connection and at least an electronic controller unit, wherein said electronic controller unit is designed and arranged in a way, that said electronic controller unit performs a method according to at least claim 1.

* * * * *